US005752359A

United States Patent [19]

Oord

[11] Patent Number: 5,752,359

[45] Date of Patent: May 19, 1998

[54] DEVICE FOR OPENING SHEET-LIKE MATERIAL, SUCH AS PACKING PAPER, AROUND A CYLINDRICAL OBJECT

[75] Inventor: Jan Van Oord, Ulvenhout, Netherlands

[73] Assignee: Sardee Industries, Inc., Oak Brook, Ill.

[21] Appl. No.: 704,661

[22] PCT Filed: Mar. 16, 1996

[86] PCT No.: PCT/NL95/00096

§ 371 Date: Oct. 16, 1996

§ 102(e) Date: Oct. 16, 1996

[87] PCT Pub. No.: WO95/25040

PCT Pub. Date: Sep. 21, 1995

[30] Foreign Application Priority Data

Mar. 16, 1994 [NL] Netherlands ..... 9400417

[51] Int. Cl.[6] ..... B65B 69/00

[52] U.S. Cl. ..... 53/381.2; 53/381.1; 414/412

[58] Field of Search ..... 53/381.1, 381.2, 53/492; 83/54, 175, 176, 946; 414/412

[56] References Cited

U.S. PATENT DOCUMENTS 5,060,456 10/1991 Wehrli ..... 53/381.2

5,101,703 4/1992 Tanaka et al. ..... 83/946

FOREIGN PATENT DOCUMENTS 139325 5/1989 Japan ..... 53/381.2

201829 7/1992 Japan ..... 53/381.1

1495223 7/1987 Sudan ..... 414/412

*Primary Examiner*—James F. Coan

*Assistant Examiner*—Gene L. Kim

*Attorney, Agent, or Firm*—Lockwood, Alex, FitzGibbon & Cummings

[57] ABSTRACT

The invention relates to a device for opening sheet-like material, such as packaging paper, around a cylindrical object, which device comprises a support for the object as well as a carrier which is movable relative to the support over a predetermined path length and provided with at least a pair of wheels. The rotation shafts of the wheels enclose an angle, such that during the movement of the carrier the wheel peripheries exert a force on the sheet-like material directed towards each other in order to pull the sheet-like material more tightly around the object and to form a buckle or standing fold. The carrier is also provided with a cutting member which is situated behind the pair of wheels in the direction of movement.

16 Claims, 1 Drawing Sheet

DEVICE FOR OPENING SHEET-LIKE MATERIAL, SUCH AS PACKING PAPER, AROUND A CYLINDRICAL OBJECT

BACKGROUND OF THE INVENTION

FIELD OF THE INVENTION

The invention relates to a device for opening sheet-like material, such as packaging paper, around a cylindrical object, which device comprises a support for the object as well as a carrier which is movable relative to the support over a predetermined path length and provided with friction means like at least a pair of wheels. The rotation shafts of the wheels enclose an angle, such that during the movement of the carrier the wheel peripheries exert a force on the sheet-like material directed towards each other in order to pull the sheet-like material more tightly around the object and to form a buckle or standing fold. The carrier is also provided with a cutting member which is situated behind the pair of wheels in the direction of movement.

Such a device is described in the Netherlands patent application no. 9201954.

The problem which can occur in practice is that the packaging around the cylindrical object becomes creased as a result of storage and transportation, which prevents the outward bulging of the packaging as a result of the rubbing effect of the friction means. This is of particular importance at the start of the operation, that is, initiating of the opening cut in the packaging, since the cutting member cannot operate optimally.

SUMMARY OF THE INVENTION

The invention has for its object to obviate the above stated drawback and provides for this purpose a device which is characterized in that at the beginning of the path length is arranged a puncture member to be inserted into said fold which can be carried transversely of the movement of the carrier from a position outside the support to a position close to the cutting member and vice versa.

Due to the puncture member which operates transversely of the direction of movement of the carrier and is situated close to the beginning of the opening cut, the packaging can initially be pierced, lifted and this lifted part of the packaging can then be cut into, whereafter the further bulging deformation of the packaging is provided by the pair of wheels.

It is noted that an inserting member for lifting the leading edge of a rotatably driven paper roll is disclosed in U.S. Pat. No. 4,821,971. This lifting member will not puncture the paper material.

If the device is embodied with a rotatably driven cutting wheel or disc, this wheel can be embodied with a lifting member which cooperates with the puncture member such that the bulging action is partially accomplished by the lifting member.

Other features and advantages of the invention will be further elucidated in the FIGURE description hereinbelow of an embodiment of the invention.

BRIEF DESCRIPTION OF THE DRAWING

The drawing shows a perspective view of an embodiment of the invention which shows a part of the device close to the beginning of the opening cut on the packaging.

DESCRIPTION OF THE PREFERRED EMBODIMENTS

Figure 1:
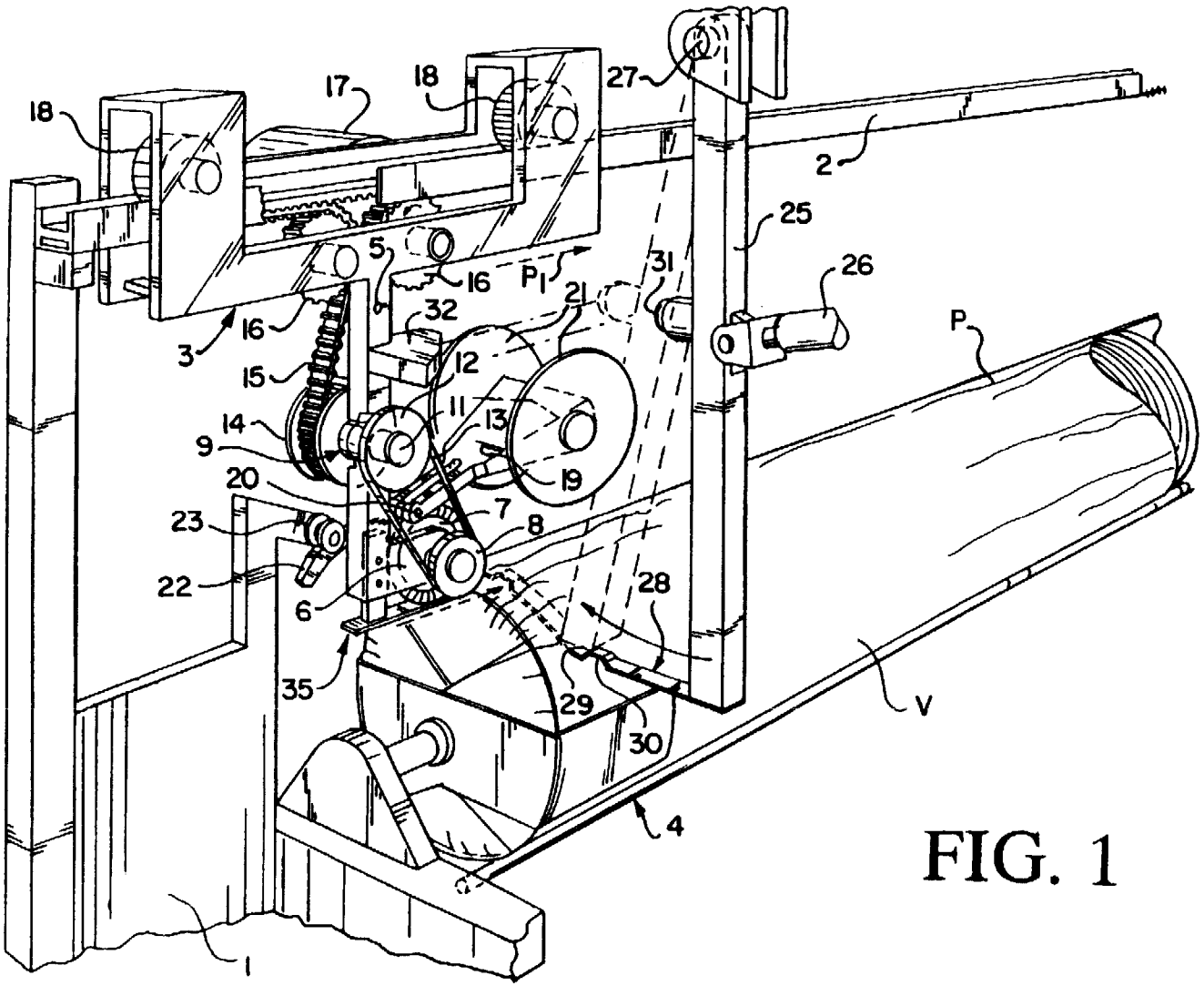

The device includes a fixed frame 1 which has a guide rail 2 along which a carrier 3 is movable in the direction of the arrow P1. The frame 1 is further provided with a support 4 which serves to receive an object V which here takes a cylindrical form and is packed in a paper envelope P which has to be removed by the device. The object V can be, for example, a quantity of bottom or cover parts of cans placed against each other.

The carrier 3 includes a downward directed support 5 which has on the underside a forward pointing leg 6. A cutting disc 7 is rotatably mounted on leg 6, wherein the bearing shaft of cutting disc 7 has a pulley 8 attached thereto.

It is noted that the downward oriented support 5 has a hinge 9, the pivot axis of which coincides with the axis of a rotation shaft 11 parallel to the rotation shaft of the cutting disc 7. Fixedly attached to the rotation shaft on the front side of the support is a pulley 12 around which is trained a belt 13, which is also trained around the pulley 8. Attached to the other side of the rotation shaft 11 is a tooth wheel 14 around which a toothed belt 15 is trained. The carrier has on either side of the upper end of support 5 two tooth wheels 16 for guiding the toothed belt 15 which is fixed against the underside of the rail 2 and which nestles against that underside of the rail during movement of the carrier 3. One of the tooth wheels 16 is driven by a motor 17 on the rear side of carrier 3. The carrier itself is suspended on the guide rail 2 by means of travel wheels 18.

The lower hinged part of support 5 is also provided with a sub-frame 19 which is hingedly connected at rotation shaft 20 to that lower part of support 5. The sub-frame 19 carries a pair of wheels 21 the rotation shafts of which enclose an angle with each other, such that in the direction of the arrow P1 the wheels are directed outwardly.

The sub-frame 19 is provided beyond the rotation shaft 20 with a finger 22 which can cooperate with a rise cam 23 which is connected to the frame 1. In the position shown the finger 22 lies under the rise cam 23 and in the drawn position raises the pair of wheels 21.

The frame is also provided with a downward directed pivot arm 25 which is movable round a horizontal pivot shaft 27 relative to the frame by means of a pneumatic cylinder 26. The underside of pivot arm 25 has an inserting member 28, which here takes the form of a blade, the free end of which is pointed at 29, wherein the underside has a recess 30.

The pivot arm is also provided with a cam 31 which cooperates with a rise stop 32 which is arranged on the fixed support 5 of carrier 3.

It is finally noted that under the part 6 of the support 5 is arranged a lifting member 35 in the form of a strip-like body, the free end of which is formed for example into a fork, between the teeth of which the cutting edge of cutting disc 7 can operate.

The above stated device operates as follows:

When an object V with packing P arranged therearound is laid onto the support 4 the wheel pair 21 is in the upward directed position.

By energizing the cylinder 26 the arm 25 is carried to the position as according to the dashed line in the FIGURE, wherein the tip 29 of the inserting member 28 penetrates through the packaging P, wherein the recess 30 is situated in front of the lifting member 35. When motor 17 is started the carrier 3 will be moved in the direction of the arrow P1 as a result of the rotation of wheel 16, whereby the lifting member 35 is moved to the right and the tip will likewise penetrate through the packaging P as far as the recess 30 of the inserting member. The wheel pair 21 will then descend because arm 22 is released from cam 23. During the continuing movement the wheel pair will cause the packaging to fold into a bulge-shaped portion behind the wheel pair and the lifting member 35 can move through freely under the packaging P. The cutting member in the form of a cutting disc 7 will apply a cut in this bulge-shaped portion, which is facilitated in that during the movement of carrier 3 the toothed belt 15 will unwind round the tooth wheel 14 which sets the belt drive 8, 12 and 13 into motion and thus the cutting member 7.

As soon as the stop 32 on the fixed support 5 contacts the cam 31, the arm 25 is pushed back in the direction of the position drawn in full lines, whereafter cylinder 26 can further be energized by a sensor (not shown) and retracts the arm 25. This retraction will take place before the support 5 approaches the point of insertion the packaging P by the inserting member.

With further movement the packaging P is cut through in a straight line.

The invention is not limited to the above described embodiment.

In order for example to enhance the ballooning effect of the packaging P, the blade-like inserting member 28 can be replaced for example by a hollow needle for supplying pressurized air under the packaging P. The hollow needle is connected for this purpose to a pressure source (not shown).

The device can also take a double-sided form, that is, a travel wheel pair 21 with cutting member 7 and lifting member 35 are arranged mirror-symmetrically under carrier 3, so that the device can also be moved along guide 2 in the direction opposite to that of P1 while cutting open a new object, but from the other side. A pivot arm 25 with inserting member 28 will of course also be arranged on the other side.

I claim:

1. A device for opening sheet-like material, such as packing paper wrapped around a cylindrical object, comprising: a support for the cylindrical object, a carrier mounted on said support and movable relative to said support over a predetermined path of travel, a frame member mounted to said carrier and extending over said cylindrical object, the frame member including a pair of wheels rotatably mounted thereon at an angle to each other each of the wheels having an outer periphery such that when said wheels are place into contact with said sheet-like material and moved along said sheet-like material during movement of said carrier, the wheel peripheries exert a force on the sheet-like material in order to pull said sheet-like material more tightly around the object and form a standing fold in said sheet-like material, a cutting member positioned behind said wheels in the direction of movement of said carrier, and a puncture member located at the beginning of said predetermined path of travel the puncture member being mounted on a puncture member support for movement in a direction transverse to said carrier movement direction, such that said puncture member can be inserted into or withdrawn from said standing fold.

2. The device according to claim 1, wherein said cutting member includes a cutting disc rotatably mounted to said carrier, said device further including a material-lifting member for engaging said sheet-like material and lifting said sheet-like material partially away from said cylindrical object, said puncture member having a recess for receiving said material-lifting member when said puncture member is inserted into said sheet-like material.

3. The device of claim 1, wherein said inserting member support includes a lever arm pivotally mounted to said inserting member support, the lever arm having a cam disposed thereon, said cam being disposed on said lever arm in position to contact a stop member positioned on said carrier.

4. The device of claim 2, wherein said inserting member support includes a lever arm pivotally mounted to said inserting member support, the lever arm having a cam disposed thereon, said cam being disposed on said lever arm in position to contact a stop member positioned on said carrier.

5. The device of claim 1, wherein said frame member is hingedly connected to said carrier for moving said wheels into and out of contact with said sheet-like material.

6. The device of claim 2, wherein said cutting member is rotatably mounted to said carrier whereby said cutting member is rotatably driven by the movement of said carrier.

7. A device for opening a package containing a series of circular objects, such as can covers that cooperatively have an overall cylindrical configuration, the package including packaging paper wrapped around said objects comprising: a support for the package, a carrier mounted on said support and movable relative to said support over a predetermined path of travel along a longitudinal axis of said package, means for forming a standing fold in the packaging paper, said carrier having a cutting member for cutting said sheet-like material along said standing fold, said cutting member being rotatable mounted to said carrier such that said cutting disc is rotatable driven along said package by movement of said carrier and a puncture member positioned at the beginning of said predetermined path of travel for puncturing said packaging paper, said puncture member being mounted for movement transversely to the direction of the movement of said carrier, such that said puncture member can be inserted into or withdrawn from said standing fold to thereby puncture said packaging paper.

8. The packaging opening device according to claim 7, wherein said cutting member includes a cutting disc rotatably mounted to said carrier, said packaging opening device further a lifting member for lifting a portion of said packaging paper for contact by said cutting member, said puncture member including a recess for receiving said lifting member.

9. The packaging opening device of claim 7, wherein said puncture member is mounted on a lever having a cam, and said lever being pivotally secured to said support such that said cam is adapted to contact a stop member positioned on said carrier.

10. The packaging opening device of claim 8, wherein said puncture member is mounted to a lever arm having a cam, said lever arm being pivotally mounted to said support such that said cam is adapted to contact a stop member positioned on said carrier for stopping the movement of said lever arm.

11. The packaging opening device of claim 7, wherein said standing fold forming means is mounted on a sub-frame, and said sub-frame is hingedly connected to said carrier.

12. A device for opening sheet-like material such as packaging around an object comprising, a support for the object, a carrier mounted on said support and movable relative to said support over a predetermined path of travel, means for holding said sheet-like material including a insert member disposed on said carrier which is inserted into said packaging paper to engage said packaging paper and means for forming a bulge-shaped portion on said sheet-like material, a cutting member mounted on said carrier for cutting said sheet-like material along said bulge-shaped portion as said carrier travels said predetermined travel path, and means for puncturing said sheet-like material at said bulge-shaped portion said puncturing means being movable in a plane that is generally transverse to said predetermined travel path and movable into and out of puncturing contact with said packaging paper, said puncturing means including a recess that receives said insert member.

13. The device of claim 12, wherein said cutting member includes a cutting disc rotatably mounted to said carrier, said device further comprising means attached to said carrier for lifting said sheet-like material at said bulge-shaped portion.

14. The device of claim 12, wherein said puncturing means is mounted on a lever having a cam, and said lever being pivotally secured to said support such that said cam is adapted to contact a stop member positioned on said carrier.

15. The device of claim 12, wherein said means for holding said sheet-like material is mounted on a sub-frame hingedly connected to said carrier.

16. The device of claim 13, wherein said cutting disc is rotatably mounted to said carrier whereby said cutting disc is rotatably driven by the movement of said carrier.

* * * * *